US005667216A

United States Patent [19]

Gunn

[11] Patent Number: 5,667,216

[45] Date of Patent: Sep. 16, 1997

[54] STRING ASSEMBLY FOR A RACKET

[76] Inventor: Robert H. Gunn, P.O. Box 190, 8 Production Way, Avenel, N.J. 07001

[21] Appl. No.: 681,715

[22] Filed: Jul. 29, 1996

[51] Int. Cl.[6] ..... A63B 51/14

[52] U.S. Cl. ..... 473/73 A

[58] Field of Search ..... 273/73 R, 73 A, 273/73 D, 73 E

[56] References Cited

U.S. PATENT DOCUMENTS

| | | | |
|---|---|---|---|
| 1,526,734 | 2/1925 | Andrews et al. | 273/73 D |
| 4,140,316 | 2/1979 | Coupar | 273/73 A |
| 4,333,649 | 6/1982 | Vaughn et al. | 273/73 D |
| 4,566,695 | 1/1986 | Melby | 273/73 D |
| 4,570,933 | 2/1986 | Michiels | 273/73 D |
| 4,593,905 | 6/1986 | Abel | 273/73 A X |
| 4,928,963 | 5/1990 | Garbosch | 273/73 A X |
| 4,949,968 | 8/1990 | Korte-Jungermann | 273/73 D X |
| 5,186,459 | 2/1993 | Korte-Jungermann | 273/73 D X |

FOREIGN PATENT DOCUMENTS

| | | | |
|---|---|---|---|
| 2598323 | 11/1987 | France | 273/73 D |

*Primary Examiner*—Raleigh W. Chiu
*Attorney, Agent, or Firm*—Louis E. Marn

[57] ABSTRACT

There is defined a racket assembly comprised of a frame portion and a handle portion wherein the frame portion is provided with orifices for tensioning each string wherein each string assembly is provided with a cap member at one end for cooperating in fixed relationship within an orifice and a serrated portion at the other end for positioning in a predetermined tension relationship in a cooperating orifice in the racket assembly.

4 Claims, 3 Drawing Sheets

STRING ASSEMBLY FOR A RACKET

BACKGROUND OF THE INVENTION

1. Field of the Invention

This invention relates generally to a method of stringing a racket assembly, and more particularly to a racket assembly for games, such as tennis, racket ball, and the like in a facile manner.

2. Description of the Prior Art

Racket assemblies for playing tennis, racket ball and the like are generally formed of one piece and comprised of an oval-shaped frame portion and a handle portion extending from the frame portion generally along a longitudinal axis of the oval-shaped frame portion. Racket assemblies have required more and more complicated and expensive manufacturing techniques. Additionally, there have existed greater demands for high quality rackets exhibiting better balance, more constant tension forces about a greater area of the stringed portion of the frame member, etc.

In U.S. Pat. No. 4,140,316 to Coupar, there is disclosed one method for stringing a racket frame having an inside and an outside surface wherein a string having two ends and a length to span the frame and having a means for maintaining the string taut comprised of a knot on each end of the string and a collar for placing over the string between each knot and the outside surface of the frame, the collars having an inside cross-sectional extent smaller than the knot and an outside cross-sectional extent greater than the apertures.

OBJECTS OF THE INVENTION

An object of the present invention is to provide a novel method of stringing a racket assembly.

Another object of the present invention is to provide a novel racket assembly of improved construction.

A further object of the present invention is to provide a novel racket assembly of improved constant tension forces of the stringed area.

SUMMARY OF THE INVENTION

These and other objects of the present invention are achieved by a racket assembly comprised of a frame portion and a handle portion wherein the frame portion is provided with a plurality of cooperating orifices for each string wherein each string is formed with a cap member at one end for positioning in fixed relationship within one cooperating orifice and a serrated portion at the other end for positioning in an insert member disposed on predetermined tension relationship in a cooperating orifice in the racket assembly.

BRIEF DESCRIPTION OF THE DRAWINGS

A better understanding of the present invention as well as other objects and advantages thereof will become apparent upon consideration of the detailed disclosure when taken with the accompanying drawings, wherein.

DETAILED DESCRIPTION OF THE INVENTION

Figure 1:
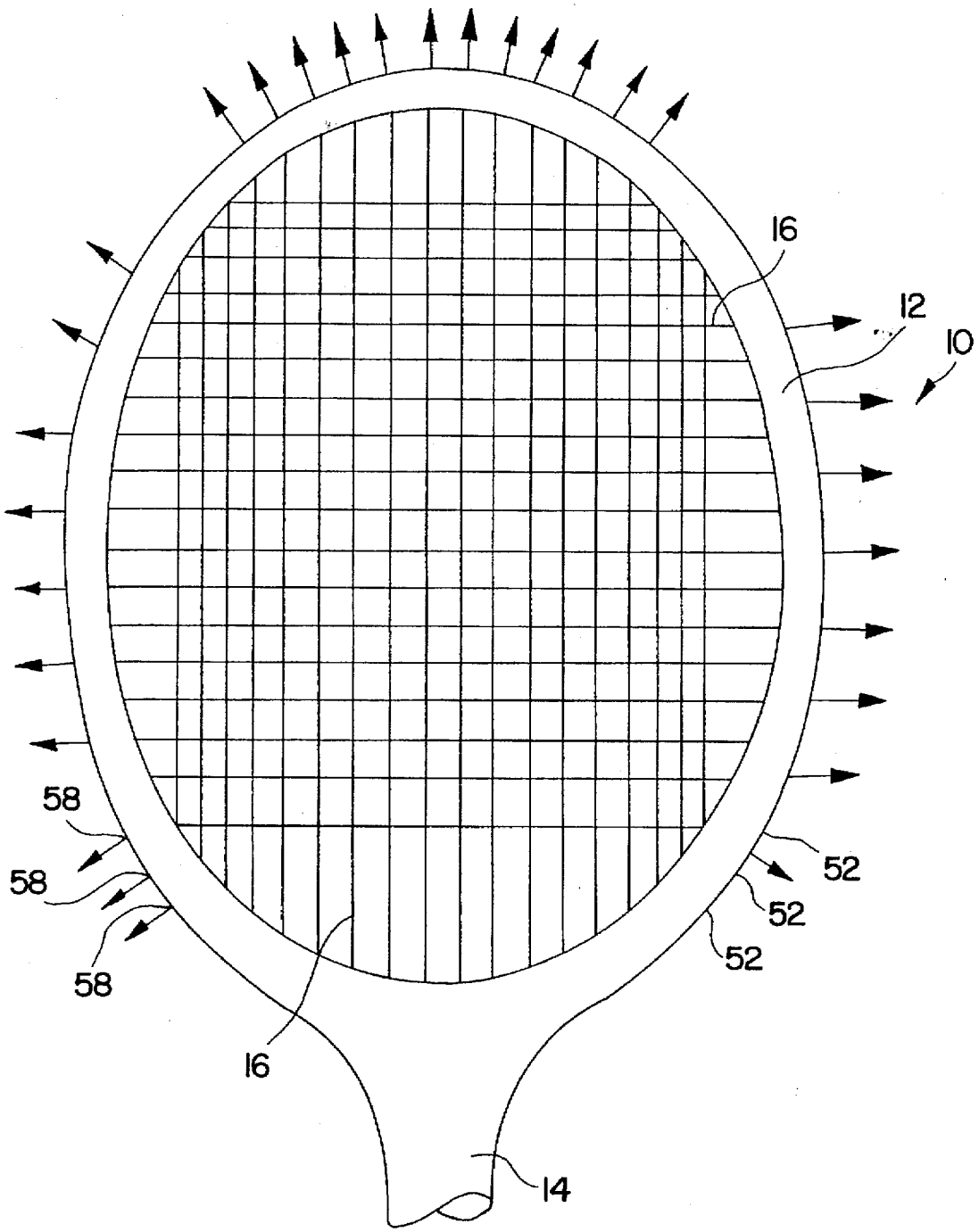
FIG. 1 is a partial elevational view of a racket assembly of the present invention.
Figure 2:
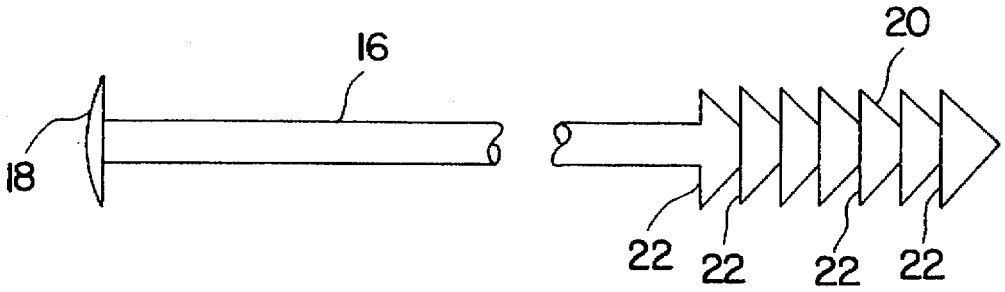
FIG. 2 is an enlarged, somewhat exaggerated view of a string assembly for use in the present invention.

Referring now to FIGS. 1 and 2, there is illustrated a racket assembly, generally indicated as 10, comprised of an oval-shaped frame portion 12 and a handle portion 14 and a plurality of vertically and horizontally-disposed strings 16.

Each string 16 is of a diverse length and is formed with a cap 18 at one end thereof and a serrated end portion 20 at the other end thereof, referring particularly to FIG. 2. Each serrated end portion 20 is formed with a plurality of planar base surfaces 22 as more fully hereinafter described.

Figure 3:
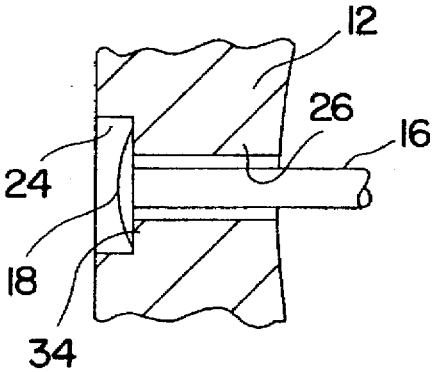
FIG. 3 is an enlarged partial view of one end of the string assembly disposed in the frame of the racket assembly of the present invention.
Figure 4:
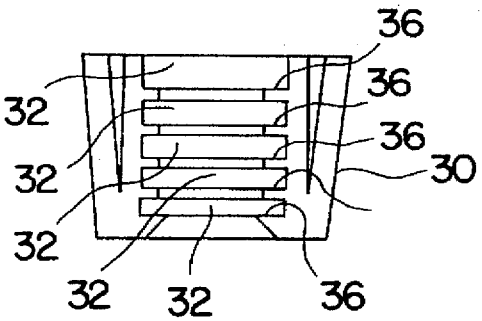
FIG. 4 is an enlarged cross-sectional side view of the insert member.
Figure 6:
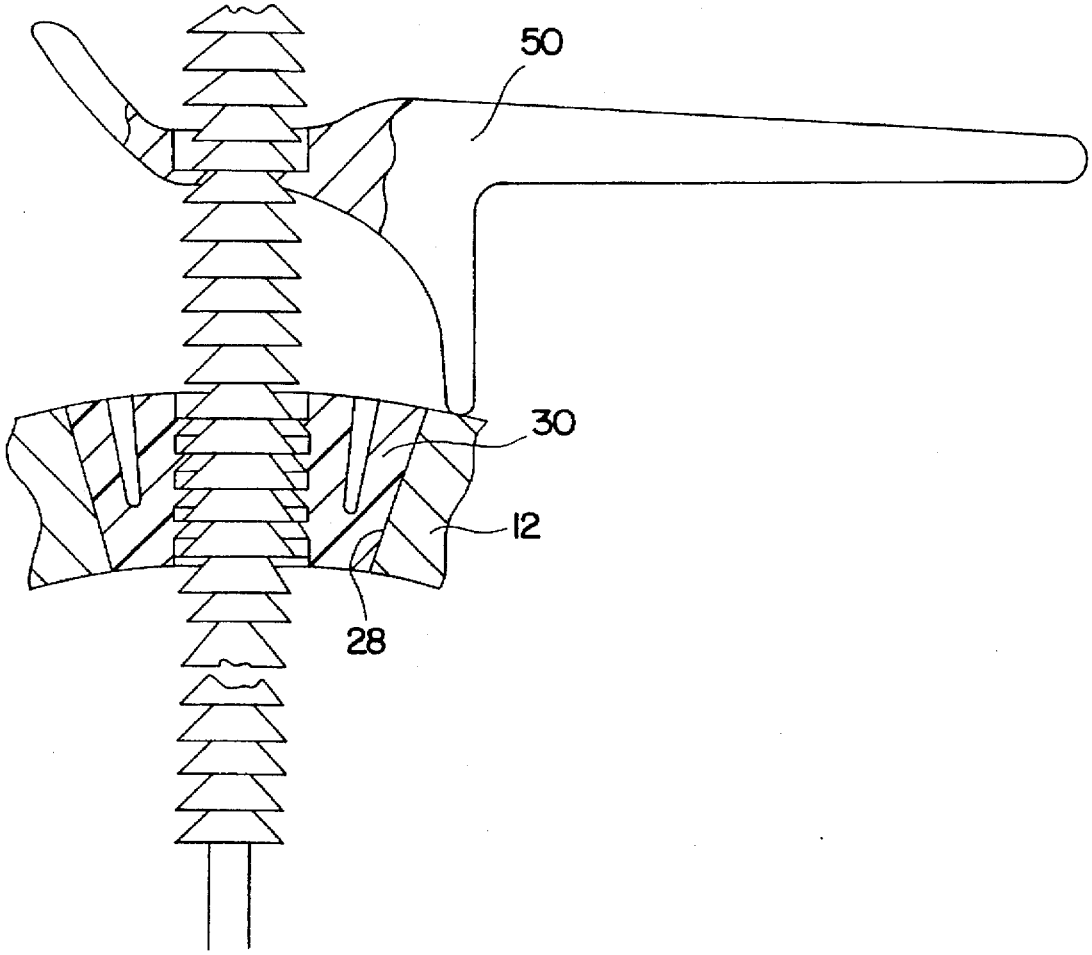
FIG. 6 is an enlarged partial, somewhat exaggerated isometric view of an insert member in which is positioned the serrated end of the string assembly in the frame of the racket assembly.

The frame portion 12 is formed with a plurality of orifices 24 leading to a smaller channel 26 for positioning the cap 18 of a string member 16 referring to FIG. 3. A conically-shaped orifice 28 is formed in the frame portion 12, referring particularly to FIG. 6, in cooperating relationship to each orifice 24. In each conically-shaped orifice 28, there is positioned a conically-shaped insert member 30, referring to FIG. 4, including a plurality of ring shaped channels 32 for engaging planar base surfaces 22 of the serrated end portion 20, as illustrated in FIG. 6.

Figure 5:
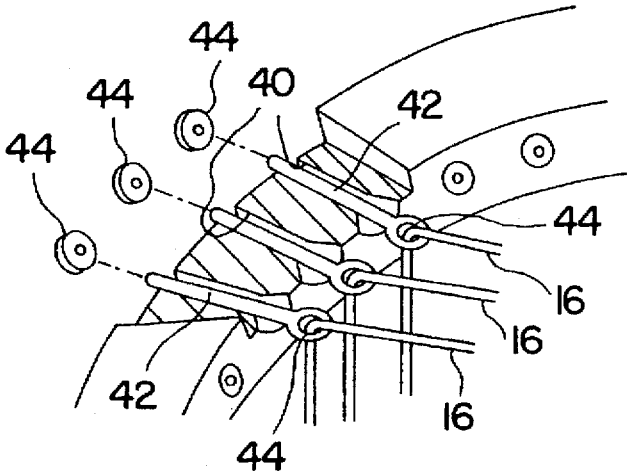
FIG. 5 is an enlarged partial isometric view of FIG. 1 of circle I illustrating coursing members positioned in the frame member of the racket assembly of the present invention.

The upper left corner portion of the frame portion 16 encircled by Roman numeral I, and upper right corner portion (not shown, but a mirror image of the upper left corner portion) encircles by Roman numeral II in FIG. 1 are formed with orifices 40 to receive threaded eyelet bolts 42 including eyelets 44 for coursing a string 16 referring to FIG. 5. Each bolt 42 is affixed within the orifice 40 to the frame portion 12, such as by nuts 44.

Corresponding to such orifices 40 are cooperating orifices 24 including channels 26 for receiving a cap 18 of string 16 of predetermined length and a conically-shaped orifice 28 for an insert member 30 for passing a serrated end portion 24 therethrough for tensioning in the direction illustrated by the arrows in FIG. 1.

In forming the racket assembly 10, each string 16 of predetermined length is coursed through a respective orifice 24 including channel 26 in the frame portion 12 to a point where the cap 18 contacts a surface 34 of the frame portion 12 formed by the orifice 24 at channel 26. Conically-shaped members 34 are positioned in preformed conically-shaped orifices 28 spatially-disposed in predetermined array about the frame portion 12 of the racket assembly 10 in the hereinbefore discussed cooperating relationship with each orifice 24. The serrated end portion 20 is coursed through a cooperating insert member 30 in the frame portion 12. Each string member 16 is tensioned to a predetermined tension level by pulling the string 16 including serrated end portion 20 by a tool 50 formed with an opening to engage a base surface 22 of the serrated end portion 20, referring particularly to FIG. 6. At a predetermined tension level, the force is eased to permit planar base surfaces 22 of the serrated end portion 20 to engage the surfaces 36 in the insert member 30 with the excess portion of the string 16 thereafter removed.

Referring to FIGS. 1 and 5, the outer three (3) horizontal strings 16 are passed through orifices 2C including channels 22 identified by 52 on frame portion 12 coursed through eyelets 44 of the eyelet member 40 at Roman numeral II and thence horizontally through eyelets 44 of the eyelet member 40 at Roman numeral I with the serrated end portion 20 finally being passed through insert member 30 in orifices 28 designated at 58 in FIG. 1. Each of such string members is subsequently tensioned in the same manner as hereinabove discussed.

Each string 16 is formed of a suitable thermoplastic material, such as nylon, which is molded of predetermined lengths with the cap 18 and a serrated end portion 20 extending of from 1 to 3 inches with each serration being spaced a distance of from 0.5 to 1.5 microns. In one embodiment of the present invention, the serrated end portion 20 is color-coded to provide preselected tensioning points, e.g., red (90 lb.), blue (85 lb.), yellow (80 lb.), etc.

While the present invention has been described in connection with several exemplary embodiments thereof, it will be understood that many modifications will be apparent to those of ordinary skill in the art, and that this application is intended to cover any adaptations or variations thereof. Therefore, it is manifestly intended that this invention be only limited by the claims and the equivalents thereof.

What is claimed:

1. A game racket assemby including a handle, which comprises:

a head frame having a plurality of sets of orifices for positioning string members, each set of said orifices having an orifice formed with a channel thereby forming a base surface and a receiving orifice;

an insert member positioned in said receiving orifice and having a planar base surface;

string members of preselect length formed with a cap portion and a serrated end portion, each of said string members being positioned through said cooperating orifices wherein said cap member is positioned on said base surface and said orifice having said channel, said serrated end portion of each of said string members positioned within said insert member, each of said string members being tensioned to a predetermined level whereby surfaces of said serrated end portion are captured on planar base surfaces of said insert member.

2. The game racket assembly as defined in claim 1 and further including coursing members having a string receiving orifice and disposed in orifices in upper side corner portions of said head frame.

3. The game racket assembly as defined in claim 2 wherein said coursing member includes a threaded end portion for receiving a bolt to hold said coursing member in said head frame.

4. The game racket assembly as defined in claim 1 wherein said insert member is a conically-shaped member and is disposed in conically-shaped cooperating orifices in said head frame.

* * * * *